US007219930B2

(12) United States Patent
Kiernan

(10) Patent No.: US 7,219,930 B2
(45) Date of Patent: May 22, 2007

(54) SNOWBOARD BACK FOOT SUPPORT APPARATUS

(76) Inventor: Doug Kiernan, 725 Corbett Ave. # 14, San Francisco, CA (US) 94131

( * ) Notice: Subject to any disclaimer, the term of this patent is extended or adjusted under 35 U.S.C. 154(b) by 0 days.

(21) Appl. No.: 11/155,121

(22) Filed: Jun. 18, 2005

(65) Prior Publication Data

US 2005/0280255 A1 Dec. 22, 2005

Related U.S. Application Data

(60) Provisional application No. 60/521,701, filed on Jun. 21, 2004.

(51) Int. Cl.
*A63C 5/06* (2006.01)

(52) U.S. Cl. ..... 280/809; 280/14.21

(58) Field of Classification Search ..... 280/809, 280/606, 816, 607, 14.21, 14.22, 815; 114/39.2; 441/70

See application file for complete search history.

(56) References Cited

U.S. PATENT DOCUMENTS 4,744,584 A * 5/1988 Monreal ..... 280/606
4,822,310 A * 4/1989 Parker et al. ..... 441/70
5,090,722 A * 2/1992 Ritchie et al. ..... 280/607
5,356,159 A * 10/1994 Butterfield ..... 280/14.22
5,564,729 A 10/1996 Gomez
5,653,467 A 8/1997 Griffin
5,904,056 A 5/1999 Ozaki
5,951,048 A 9/1999 Slaughter
6,089,592 A 7/2000 Negus
6,257,613 B1 7/2001 Porte
6,290,260 B1 9/2001 Brill
6,349,968 B1 2/2002 Crego
6,422,048 B1 * 7/2002 Fontes et al. ..... 70/58
6,457,746 B1 10/2002 Schepers
2003/0011172 A1 1/2003 Compton
2004/0032122 A1 * 2/2004 Giannulli ..... 280/809

FOREIGN PATENT DOCUMENTS

FR 2677261 11/1992
WO WO9514512 6/1995

* cited by examiner

*Primary Examiner*—J. Allen Shriver
(74) *Attorney, Agent, or Firm*—Ariel Bentolila; Bay Area IP, LLC

(57) ABSTRACT

A device is provided for supporting at least part of the weight of a snowboard on a boot of a snowboarder while sitting in a chairlift having no footrest, the snowboard having a boot binding for receiving and securing the boot onto the snowboard, where the device includes an elongated support member having a central portion, and fasteners at both ends, one for joining to the boot, and the other for joining to the boot binding so that the elongated support member is operable to transfer at least a portion of the weight on the boot binding to the boot. Other techniques are described that incorporate the foregoing back foot support device directly into the boot binding, by, for example, the boot binding manufacturer.

17 Claims, 7 Drawing Sheets

Section A-A

Section B-B

SNOWBOARD BACK FOOT SUPPORT APPARATUS

CROSS-REFERENCE TO RELATED APPLICATIONS

The present Utility patent application claims priority benefit of the U.S. provisional application for patent No. 60/521,701 filed on Jun. 21, 2004 under 35 U.S.C. 119(e).

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

FIELD OF THE INVENTION

The present invention pertains to snowboarding equipment. More specifically, the invention relates to snowboards having a back foot attachment point.

BACKGROUND OF THE INVENTION

A large percentage of chairlifts on ski and snowboard mountains do not have rests for the rider's feet while the rider is riding the chair up the mountain. This creates a major inconvenience for a chairlift rider using a snowboard. When a chairlift rider is wearing a snowboard, the snowboard is only attached to the front foot. The orientation of the foot across the snowboard is close to perpendicular. The front foot is not centered on the board and an uncomfortable twisting load is transferred to the foot and subsequently the ankle and knee of the rider. This is not a major inconvenience for skiers because a skier has one ski on each leg and the weight is evenly distributed.

This problem has been felt since the inception of snowboarding. Known approaches to solve this problem include different types of tethers to the board that are either connected to the rider or attach to the lift, and features added to the snowboard to support the weight of the snowboard with the rear foot. Tethers can be complicated and uncomfortable to attach to the body when that is the design. Tethers can also be difficult and dangerous to hook and unhook while on the chairlift. It is also an extra part to carry around. One known feature that may be added to the snowboard is a base plate that is mounted between the binding and the board. Attached to the base plate is a hook that the rider can use to support the load of the board with their back foot. This design can affect the performance of the snowboard by changing the stiffness due to the added attachment plate. The plate also raises the height of the back binding. Further, this relatively large and complex assembly would not be inexpensive to manufacture and would be difficult to assemble. Some of the other designs require adding holes to the snowboard as part of the design. This is undesirable on many levels and would void the warrantee of the snowboards.

In view of the foregoing, there is a need for improved techniques of snowboard design, which enable a chairlift rider to support the weight of the snowboard with his back foot while not affecting the performance of the snowboard.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2*a* shows an isolated transparent, top view of the back foot attachment point, FIG. 2*b* shows an isolated transparent, side view of the back foot attachment point, FIG. 2*c* shows an isolated front view of the back foot attachment point, and FIG. 2*d* shows an isolated perspective view of the back foot attachment point;

FIG. 5*a* shows an isolated side and top cross-sectional view of the exemplary back foot attachment point mounting point, and FIG. 5*b* shows a transparent front view of the exemplary back foot attachment point mounting point;

FIG. 6*a* shows an isolated transparent side and front cross-sectional view of the back foot attachment point, FIG. 6*b* shows an isolated transparent side and front view of the back foot attachment point, and FIG. 6*c* shows an isolated transparent side and cross-sectional view of the back foot attachment point.

Figure 1:
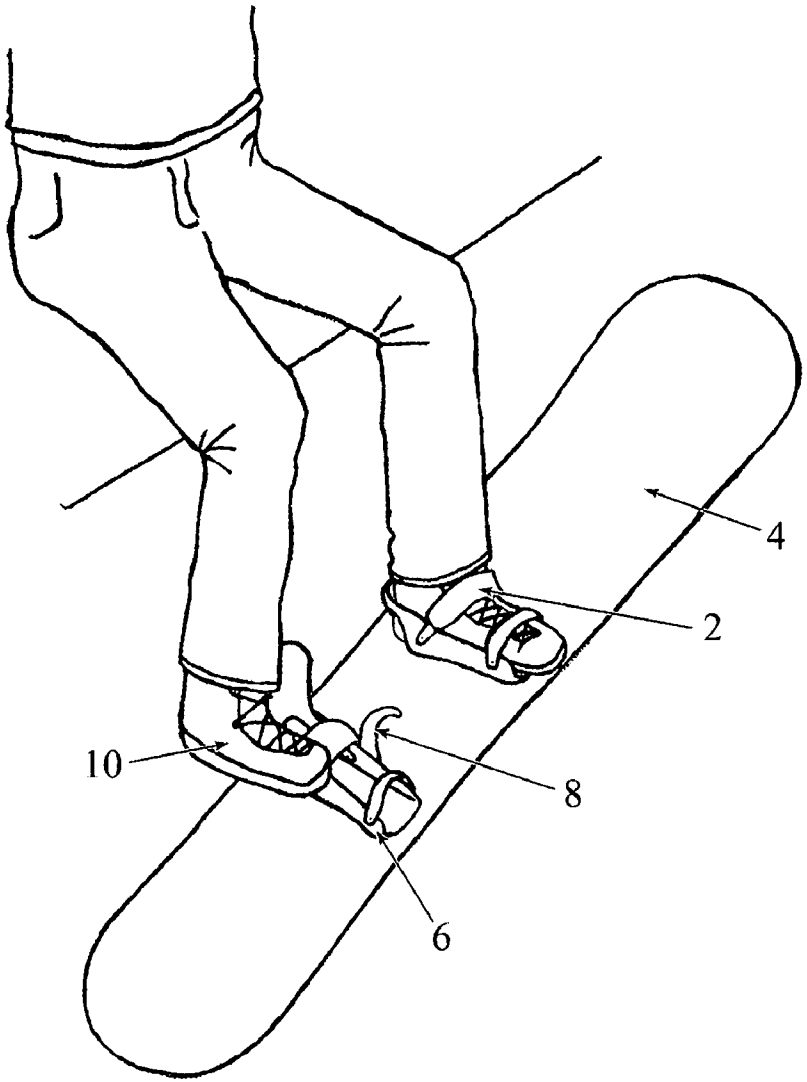
FIG. 1 illustrates an exemplary snowboard 4 adapted with a back foot attachment point 8, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a variety of techniques for back foot support devices are described.

In one embodiment, a device is provided for supporting at least part of the weight of a snowboard on a boot of a snowboarder while sitting in a chairlift having no footrest, the snowboard having a binding for receiving and securing the boot onto the snowboard, where the device includes an elongated support member having a central portion, a boot engagement end portion, and a binding joining end portion, and a first fastener operable for removably and securely joining the boot engagement end portion to the boot (other means are also provided to achieve this function), the boot engagement end portion is configured with the first fastener to thereby be operable for removably joining the elongated support member to the boot. At the other end of elongated support member, a second fastener operable for joining the binding joining end portion to the binding is provided (other means are also provided to achieve this function), the binding joining end portion is configured with the second fastener to thereby be operable for joining the elongated support member to the binding; hence the elongated support member is operable to transfer at least a portion of the weight on the binding to the boot. In some embodiments of the present invention, the first fastener is a tooth, Velcro, a magnet, sticky rubber, custom clamp, custom plug, ridge, or nub, and the second fastener is configured to be mountable to a toe strap, a heel strap, a screwable hole, or a high-back adjustment point of the binding.

Alternate embodiments of the present invention, further include a flexible joint between the central portion and the boot engagement end portion or between the central portion and the binding joining end portion.

Yet other embodiments are described that incorporate the foregoing back foot support device embodiments into the binding, by, for example, the binding manufacturer.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments.

One aspect of the present invention is to provide a snowboard with a back foot attachment point that enables a chairlift rider to support part of the weight of the snowboard with his back foot while riding the chairlift. By supporting part of the weight of the snowboard with his back foot, the rider will avoid the uncomfortable twisting load on his front foot, ankle and knee created when the entire weight of the snowboard is placed on the front foot. This twisting load is created because of the position of the front foot on the snowboard. The front foot is not centered on the snowboard and is oriented almost perpendicularly to the snowboard.

An embodiment of the invention provides a snowboard adapted with a back foot attachment point that is easy to use, convenient, and in preferred application does not generally affect the performance of the snowboard.

FIG. 1 illustrates an exemplary snowboard 4 adapted with a back foot attachment point 8, in accordance with an embodiment of the present invention. Apart from back foot attachment 8 and associated structures, snowboard 4 is a conventional snowboard with a conventional front binding 2 and a back binding 6. In the preferred embodiment shown, back foot attachment point 8 is a feature that extends from back binding 6 and holds onto a back foot 10 such that the back foot 10 can share the weight of snowboard 4 when riding a chairlift when no foot support bar is present. In some embodiments, back foot attachment point 8 may be a separate unit mounted to back binding 6, while in other embodiments, back foot attachment point 8 may be designed and manufactured into back binding 6.

In a typical application, the chairlift rider would join back foot attachment point 8 to the boot of back foot 10, causing the weight of the snowboard to be shared by both the front foot and back foot 10 of the chairlift rider. With the weight of the snowboard being distributed between both feet, the twisting load would no longer be significantly transferred to the rider's front foot.

Figure 2A:
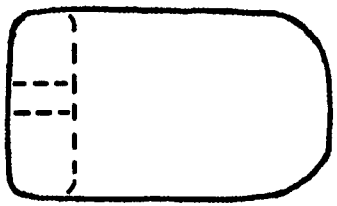
FIGS. 2*a*, 2*b*, 2*c* and 2*d* illustrate, by way of example, an isolated back foot attachment point, where the back foot attachment point is a separate unit that can be mounted to the back foot binding 6, referenced in FIG. 1, in accordance with an embodiment of the present invention.
Figure 2B:
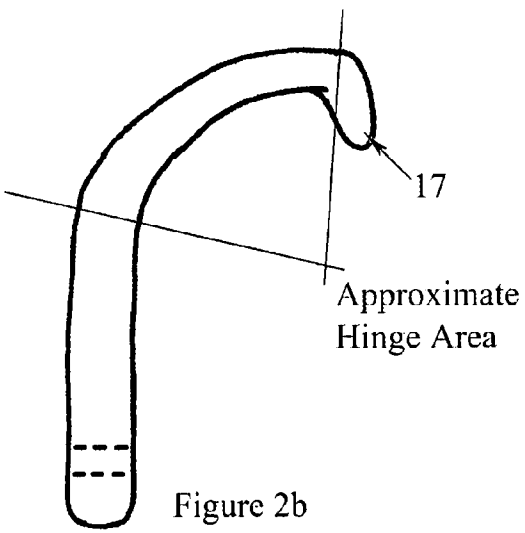
Figure 2C:
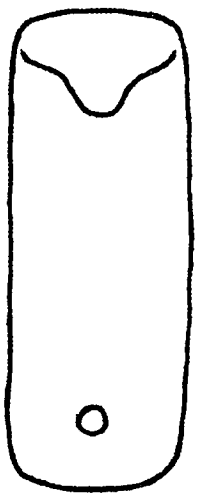
Figure 2D:
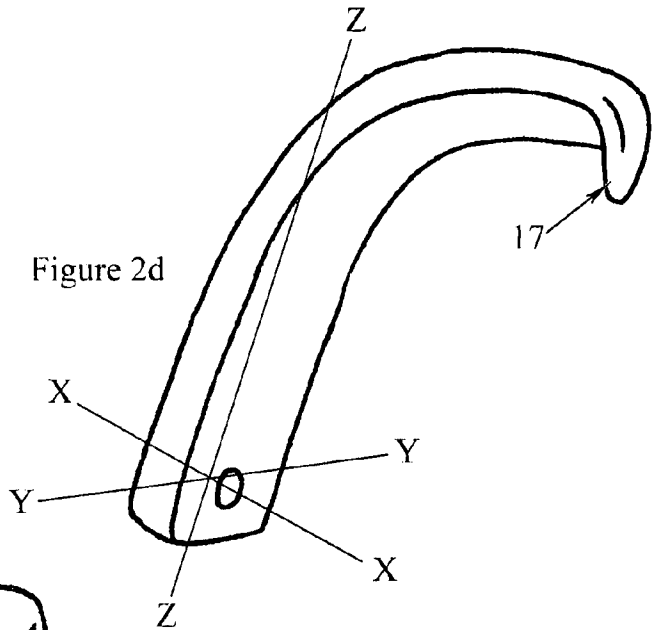

FIGS. 2*a*, 2*b*, 2*c* and 2*d* illustrate, by way of example, an isolated back foot attachment point, where the back foot attachment point is a separate unit that can be mounted to the back foot binding 6, referenced in FIG. 1, in accordance with an embodiment of the present invention. FIG. 2*a* shows an isolated transparent, top view of the back foot attachment point, FIG. 2*b* shows an isolated transparent, side view of the back foot attachment point, FIG. 2*c* shows an isolated front view of the back foot attachment point, and FIG. 2*d* shows an isolated perspective view of the back foot attachment point. In the present embodiment, the back foot attachment point includes a feature to assist in holding onto back foot 10 shown in FIG. 1. Presently it is shown as but not limited to a tooth 17 at the tip of the back foot attachment point that would grab onto the boot of back foot 10 shown in FIG. 1.

Figure 3:
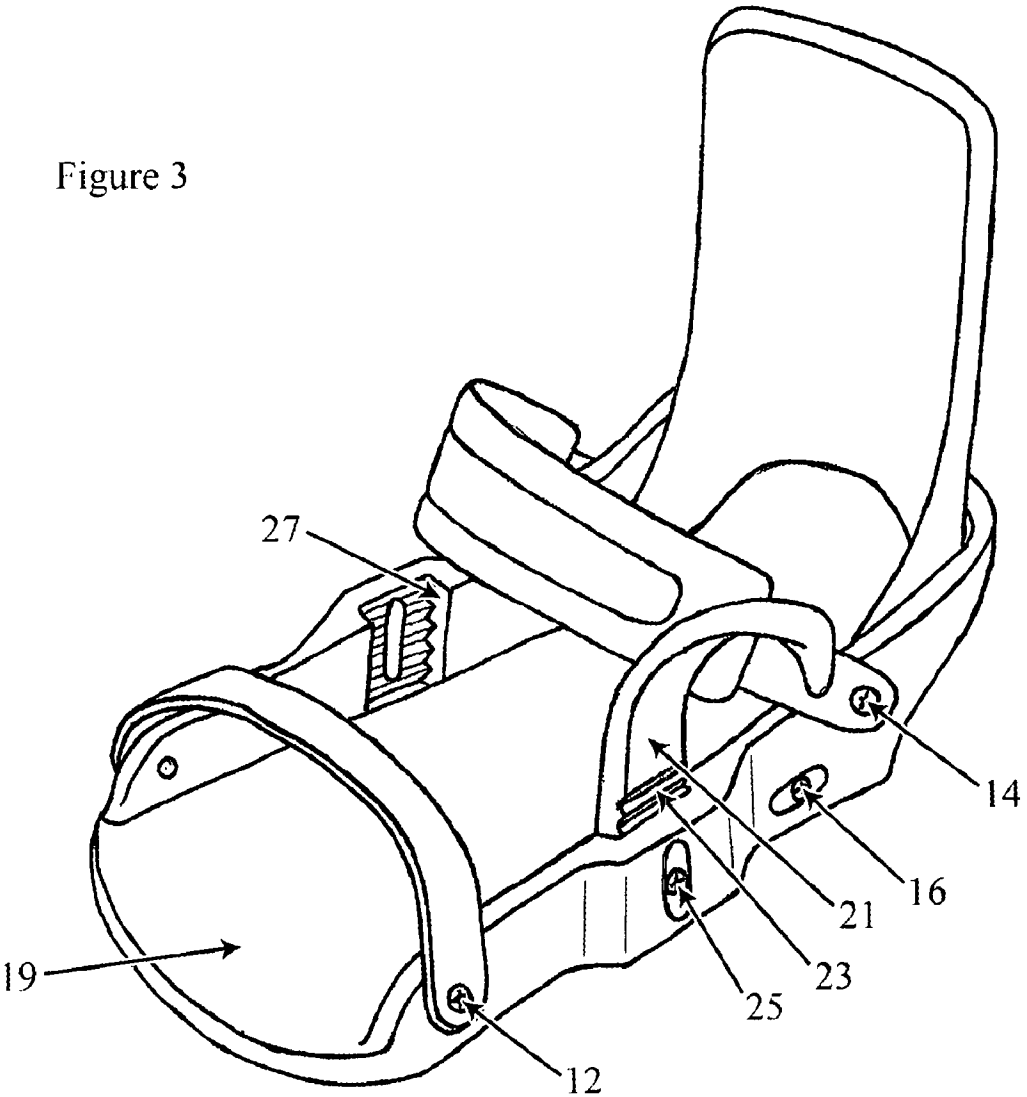
FIG. 3 illustrates an exemplary back binding 19 where a back foot attachment point 21 is designed into binding 19 when manufactured, in accordance with an embodiment of the present invention.

FIG. 3 illustrates an exemplary back binding 19 where a back foot attachment point 21 is designed into back binding 19 when manufactured, in accordance with an embodiment of the present invention. Moreover, in some embodiments the height and/or length of back foot attachment point 21 may be adjustable. In the present embodiment, exemplary means are shown for enabling the height adjustment of back foot attachment point 21. These height adjustment means are shown as, but not limited to, mating ridges 23 on back foot attachment point 21 and back binding 119. The height of back foot attachment point 21 could be adjusted by moving it up and down with respect to back binding 19, engaging mating ridges 23 at the desired height, and then tightening back foot attachment point 21 in to place, by way of example, with a screw or bolt 25. Depending on the needs of the particular application, some embodiments may include a second set of mating ridges 27 on the outside of back binding 19 so that back foot attachment point 21 may be placed on either side of back binding 19. In an alternate embodiment of the present invention, if back foot attachment point 21 is not present and designed into the binding, a separate back foot attachment point, such as back foot attachment point 8 of FIG. 1, may be mounted to back binding 19 at points including but not limited to, a toe strap 12, a heel strap 14, and a high-back adjustment point 16. In the present embodiment, the back foot attachment point may be mounted to binding 19 by, but not limited to, a bolt or screw in the existing holes located at, but not limited to, toe strap 12, heel strap 14 or high-back adjustment point 16.

Figure 4:
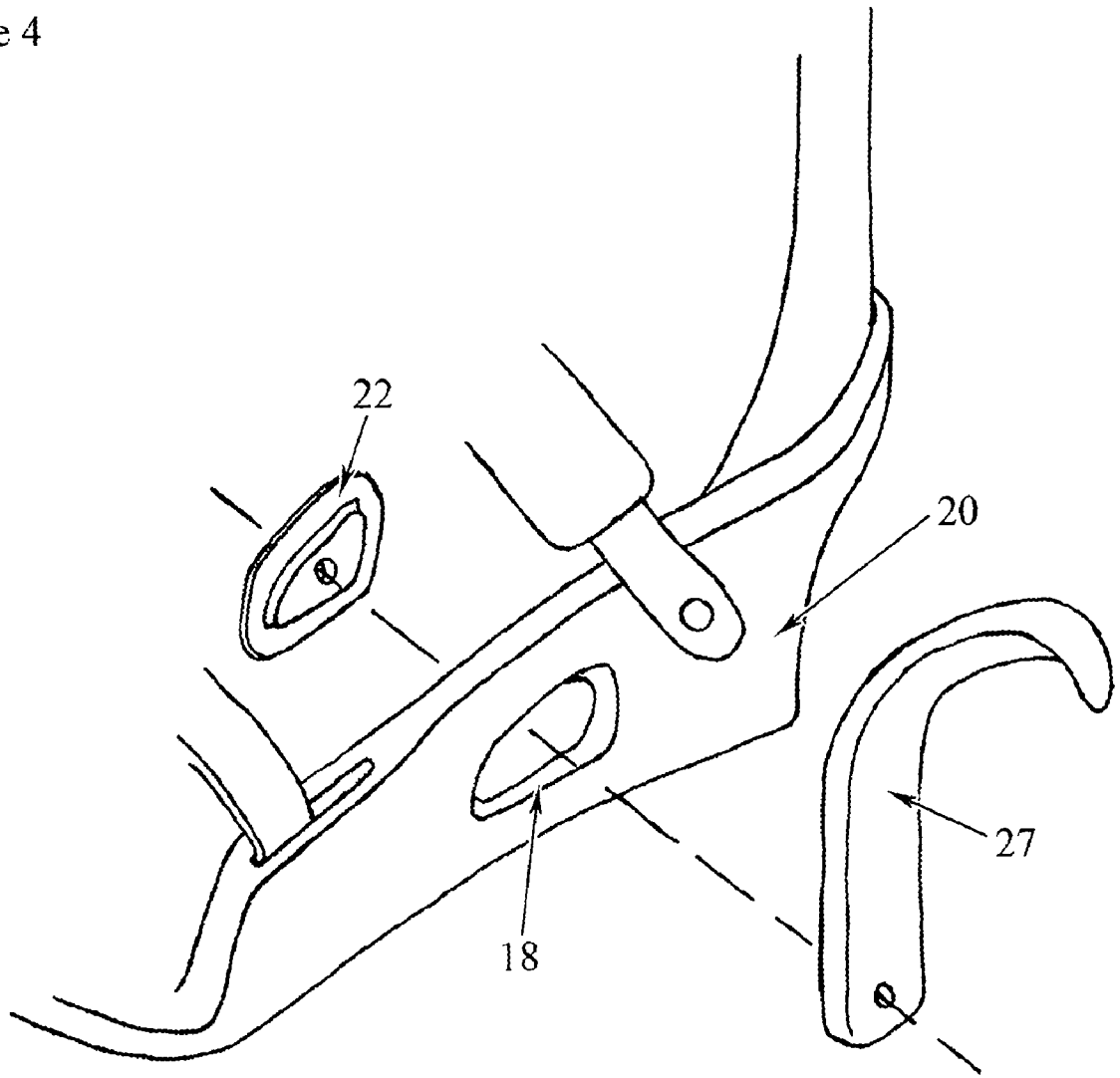
FIG. 4 illustrates, by way of example, an alternate embodiment for the mounting point of the back foot attachment point to the binding, in accordance with an embodiment of the present invention.

FIG. 4 illustrates, by way of example, an alternate embodiment for the connection point of the back foot attachment point to the binding, in accordance with an embodiment of the present invention. In the embodiment shown, a hole or feature 18 in a binding 20 can be fitted with a custom part 22. Custom part 22 would be a feature of the back foot attachment point so that the back foot attachment point 27 may be mounted to binding 20. Examples of custom parts that may be included in this embodiment of the invention include, but are not limited to, custom clamps and plugs.

Figure 5B:
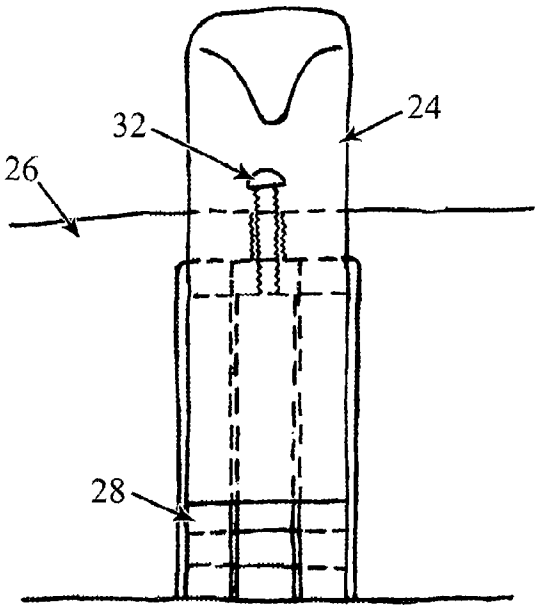
FIGS. 5*a* and 5*b* illustrate, by way of example, an alternate embodiment for the mounting point of the back foot attachment point designed into the binding by the manufacturer, in accordance with an embodiment of the present invention.
Figure 5A:
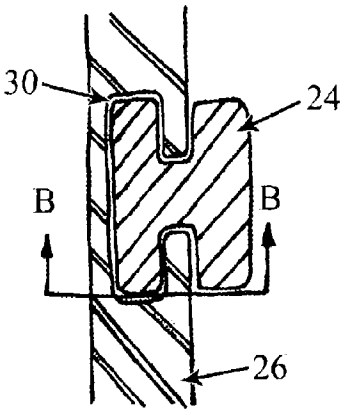
Figure 5A:
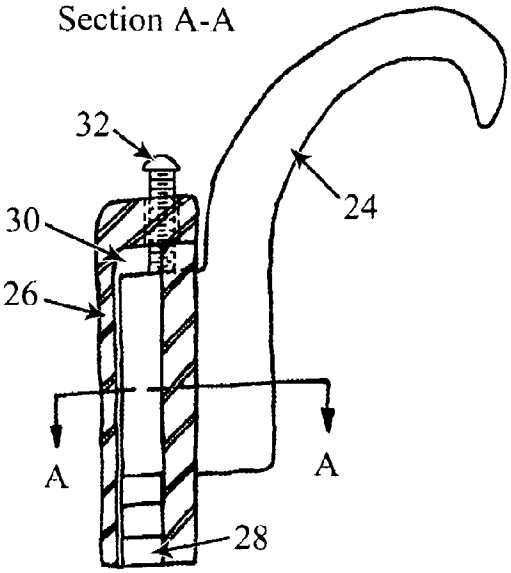

FIGS. 5*a* and 5*b* illustrate, by way of example, an alternate embodiment for the mounting point of the back foot attachment point to the binding, in accordance with an embodiment of the present invention. FIG. 5*a* shows an isolated side and top cross-sectional view of the exemplary back foot attachment point mounting point, and FIG. 5*b* shows a transparent front view of the exemplary back foot attachment point mounting point. In the embodiment shown, binding 26 is includes a t-slot 30 into which a back foot attachment point 24 may be inserted for mounting onto back binding 26. Some embodiments may have features that would allow for the adjustment of back foot attachment point 24, including, but not limited to height adjustment. In the present embodiment, back foot attachment point 24 can be adjusted vertically in back binding 26 by adding or removing spacers 28 in t-slot 30 then tightened into place, for example, with a screw or bolt 32.

Using known techniques, those skilled in the art will recognize a multiplicity of alternate and suitable means for mounting the back foot attachment point to the back bindings in accordance with the teachings of the present invention.

Figure 6A:
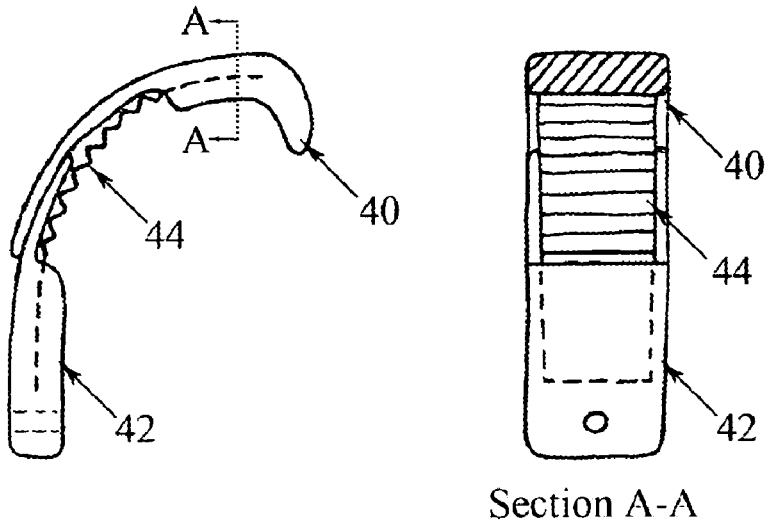
FIGS. 6*a*, 6*b* and 6*c* illustrate, by way of example, an alternate embodiment for the back foot attachment point in which the back foot attachment point may collapse, in accordance with an embodiment of the present invention.
Figure 6B:
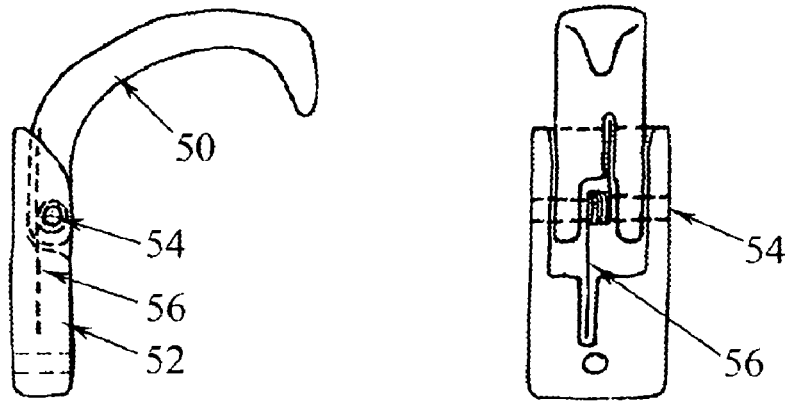
Figure 6C:
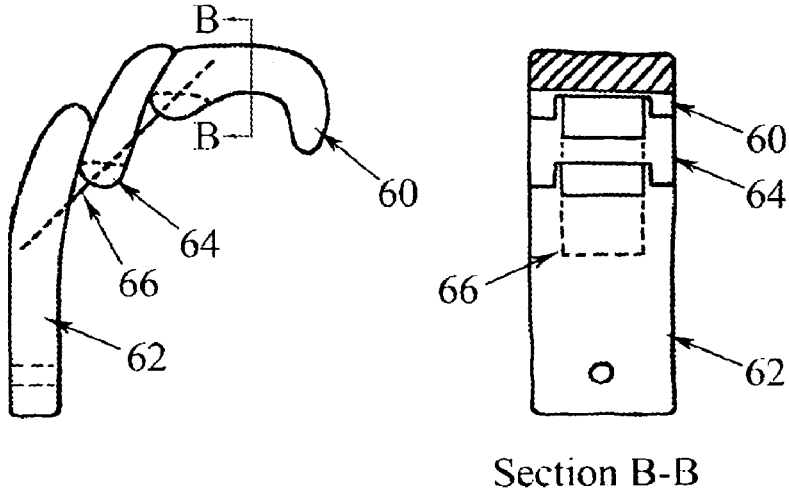

FIGS. 6*a*, 6*b* and 6*c* illustrate, by way of example, an alternate embodiment for the back foot attachment point in which the back foot attachment point may collapse. FIG. 6*a* shows an isolated transparent side and front cross-sectional view of the back foot attachment point, FIG. 6*b* shows an isolated transparent side and front view of the back foot attachment point, and FIG. 6*c* shows an isolated transparent side and cross-sectional view of the back foot attachment point.

The back foot attachment may be configured to be capable of being moved out of the way. By way of example, and not limitation, hinges, living hinges, a swivel or flexible materials may be used to enable the back foot attachment to be moved out of the way when desired. This can be accomplished along any of the 3 axes shown in FIG. 2*d* or in the approximate hinge area shown in FIG. 2*b*. In many applications, the hinge feature proves helpful to provide the back foot attachment a place to go when stepped on, thereby reducing the risk of failure to the back foot attachment and avoiding damage typically caused to the binding.

Depending upon the needs of the particular application, hinges may be provided at appropriate pivoting points to allow the back foot attachment to be rotated out of the way when desired. For example, enabling rotation in the plane of the back foot attachment is typically most effective when the rider steps down on the top of the back foot attachment point. Three embodiments for the hinge approach are shown by way of example in FIGS. 6*a, b*, and *c*.

In the embodiment shown in FIG. 6*a*, the back foot attachment point is split into a top section 40 and a bottom section 42. As shown in the exemplary figure, top section 40 and bottom section 42 are joined together by a spring material 44. In the present embodiment, bottom section 42 may be mounted to the back binding causing it to remain in a fixed position. Top section 40 may collapse when a downward force, being the rider's foot, is applied. In the present embodiment, when the back foot attachment point is in use on the chairlift, an upward load is applied to top section 40 and top section 40 will remain in the drawn configuration.

In the embodiment shown in FIG. 6*b*, the back foot attachment point is split into a top section 50 and a bottom section 52. Top section 50 and bottom section 52 are joined together by a pin 54 and a spring 56. In the present embodiment, bottom section 52 may be fixed to the back binding so that it remains in a fixed position. Top section 50 may collapse when a downward force, being the rider's foot, is applied. When the back foot attachment point is in use on the chairlift, and an upward load is applied to top section 50 and top section 50 will stay in the drawn configuration.

In the embodiment shown in FIG. 6*c*, the back foot attachment point is split into a top section 60 a bottom section 62 and a middle section 64. As shown in the exemplary figure, the multiplicity of sections is joined together by a piece of spring material 66. In the present embodiment, top section 60 and middle section 64 may collapse when a downward force, being the rider's foot, is applied. When the back foot attachment point is in use on the chairlift, and an upward load is applied to top section 60, the back foot attachment point will stay in the drawn configuration.

Figure 7B:
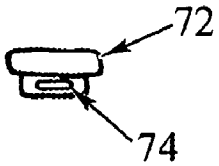
FIGS. 7*a, b, c*, and *d* illustrate, by way of example, various views of a back foot attachment point as a stand-alone part, and as applied to a typical boot.
Figure 7C:
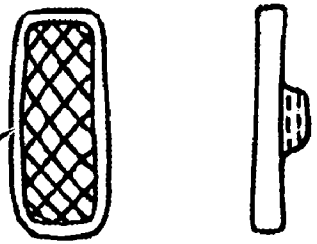
Figure 7D:
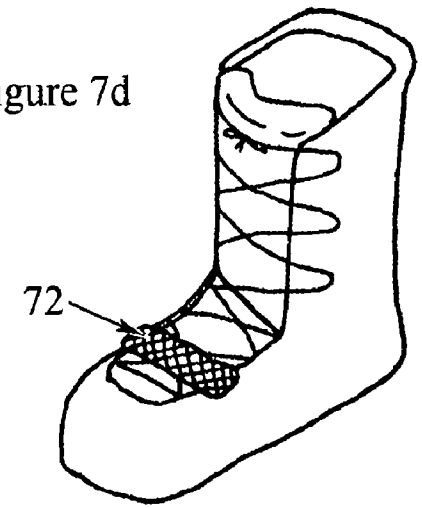
Figure 7A:
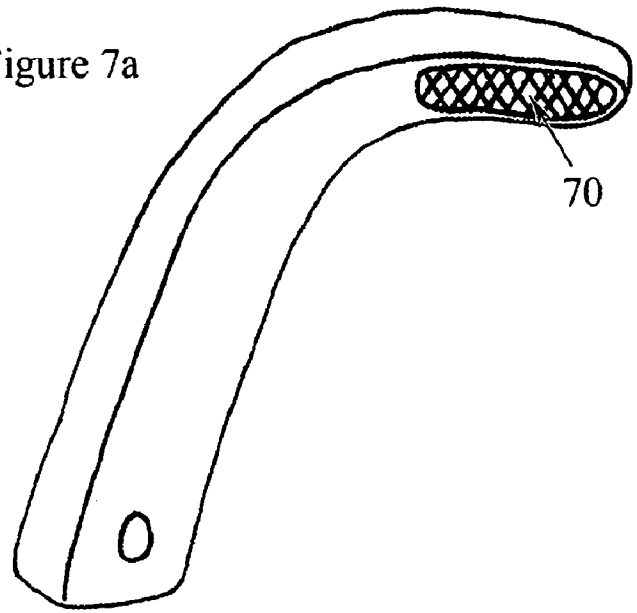

FIGS. 7*a, b, c, d*, and *e* illustrate, by way of example, various views a back foot attachment point as a stand-alone part, and as applied to a typical boot.

FIG. 7*a* illustrates an exemplary back foot attachment point as hatched area 70. This hatched area would be the location to attach the attachment means such as, without limitation, Velcro, a magnet, sticky rubber, ridges or nubs. In many applications, a second part would be required for this design. The second part would be for the mating the attachment means. FIG. 7*c* illustrates, by way of example, front and side views of a suitable part 72 that would be attached to the boot. In alternate embodiments of the present invention, this mating attachment point is designed directly into the boot. In some applications, the attachment is achieved by passing the laces of the boot through an attachment hole 74 on the back of part 72, as shown by way of example in FIG. 7*b*, which shows a top view of part 72. As shown by way of example in FIG. 7*d*, part 72 rests preferably on the boot top where it is held in place by the boot laces.

In some embodiments, the features used to assist in holding onto the back foot may be, but are not limited by, Velcro™ hook and loop material on the tip of the back foot attachment point that mates with Velcro™ hook and loop material on the back foot or a magnet located on the tip of the back foot attachment point that would be attracted to another magnet or a piece of metal located on the boot of the back foot. In some embodiments, the mating part could be designed into the boot itself.

In alternate embodiments of the present invention, the back foot attachment point may, according to the teachings of the present invention, be suitably configured according to known techniques for added support and control when performing what is referred to as "skating", e.g., the back foot being out of the binding while riding. In many applications, this is capability is helpful when traversing flat ground or riding around with the back foot is on the board and not in the binding. It is contemplated that the present embodiment is suitable to enable a new class of 'one-footer' tricks, which the present embodiment would at least provide more control going into and out of a given trick.

Using known techniques, those skilled in the art will, in light of the teachings of the present invention, recognize a multiplicity of alternate and suitable means for allowing the back foot attachment point to fold out of the way in accordance with the teachings of the present invention. For example, without limitation, the back foot attachment point could be made out of a flexible material or mounted to the snowboard by means of a hinge or a swivel.

Having fully described at least one embodiment of the present invention, other equivalent or alternative back foot support devices according to the present invention will be apparent to those skilled in the art. The invention has been described above by way of illustration, and the specific embodiments disclosed are not intended to limit the invention to the particular forms disclosed. The invention is thus to cover all modifications, equivalents, and alternatives falling within the spirit and scope of the following claims.

What is claimed is:

1. A device for supporting at least part of the weight of a snowboard on a boot of a snowboarder while sitting in a chairlift having no footrest, the snowboard having a binding for receiving and securing the boot onto the snowboard, the device comprising:

an elongated support member having a central portion, a boot engagement end portion, and a binding joining end portion;

means for removably and securely joining said boot engagement end portion to the boot, said boot engagement end portion being configured with said boot engagement joining means to thereby be operable for removably joining said elongated support member to the boot; and means for joining said binding joining end portion to the binding, said binding joining end portion being configured with said binding joining means to thereby be operable for joining said elongated support member to the binding, said binding joining means being configured to not gain structural support from under the binding, and said elongated support member being operable to transfer at least a portion of the weight on the binding to the boot.

2. The support device of claim 1, further comprising a flexible joint between said central portion and said boot engagement end portion.

3. The support device of claim 1, wherein said flexible joint is a hinge.

4. The support device of claim 1, further comprising a flexible joint between said central portion and said binding joining end portion.

5. The support device of claim 4, wherein said flexible joint is a hinge.

6. The support device of claim 1, wherein said central portion is comprised of a compliant material.

7. A binding for supporting at least part of the weight of a snowboard on a boot of a snowboarder while sitting in a chairlift having no footrest, the snowboard having the binding for receiving and securing the boot onto the snowboard, the binding comprising:

an elongated support member having a central portion, a boot engagement end portion, and a binding joining end portion, said binding joining end portion being joined with said binding such that said binding joining end portion does not gain structural support from under the binding, and said boot engagement end portion protruding from said binding; and means for removably and securely joining said boot engagement end portion to the boot, said boot engagement end portion being configured with said boot engagement joining means and oriented to be operable for being joined to the boot to thereby be operable for removably joining said elongated support member to the boot and transfer at least a portion of the weight on the binding to the boot.

8. The support device of claim 7, further comprising a flexible joint between said central portion and said boot engagement end portion.

9. The support device of claim 8, wherein said flexible joint is a hinge.

10. The support device of claim 7, further comprising a flexible joint between said central portion and said binding joining end portion.

11. The support device of claim 10, wherein said flexible joint is a fringe.

12. The support device of claim 7, wherein said central portion is comprised of a compliant material.

13. The support device of claim 7, wherein said binding joining end portion is joined with said binding by means for joining said binding joining end portion with said binding.

14. The support device of claim 7, wherein said binding joining end portion is joined to a side of said binding.

15. The support device of claim 7, wherein said binding joining end portion is compliantly joined with said binding.

16. The support device of claim 7, wherein said binding joining end portion is adjustably joined with said binding to be operable for height adjustment of said elongated support member.

17. The support device of claim 7, wherein said binding joining end portion is built as part of the binding by the binding manufacturer and suitably joined accordingly thereby.

* * * * *